US009758906B2

(12) United States Patent
Miller et al.

(10) Patent No.: US 9,758,906 B2
(45) Date of Patent: Sep. 12, 2017

(54) BEAD WEAVING LOOM

(71) Applicant: M & G Partners, LLP, Milwaukee, WI (US)

(72) Inventors: Mark Miller, Milwaukee, WI (US); Goldi Miller, Milwaukee, WI (US); Myra Mouloudji, Milwaukee, WI (US)

(73) Assignee: M & G Partners, LLP, Milwaukee, WI (US)

( * ) Notice: Subject to any disclaimer, the term of this patent is extended or adjusted under 35 U.S.C. 154(b) by 0 days.

(21) Appl. No.: 14/970,013

(22) Filed: Dec. 15, 2015

(65) Prior Publication Data

US 2016/0168766 A1 Jun. 16, 2016

Related U.S. Application Data

(60) Provisional application No. 62/092,705, filed on Dec. 16, 2014.

(51) Int. Cl.

| | |
|---|---|
| ***D03D 29/00*** | (2006.01) |
| ***D03D 15/00*** | (2006.01) |
| *D03D 41/00* | (2006.01) |

(52) U.S. Cl.
CPC ..... *D03D 29/00* (2013.01); *D03D 15/0022* (2013.01)

(58) Field of Classification Search
CPC ..... D03D 29/00; D04B 3/00; D04B 5/00
See application file for complete search history.

(56) References Cited

U.S. PATENT DOCUMENTS

| | | | | | |
|---|---|---|---|---|---|
| 737,073 | A | | 8/1903 | Bush | |
| 1,995,384 | A | * | 3/1935 | Fletcher | D03D 29/00 139/34 |
| 2,043,082 | A | * | 6/1936 | Wallach | G03D 29/00 28/151 |
| 2,504,940 | A | * | 4/1950 | Wallach | D03D 29/00 28/151 |
| 2,601,222 | A | * | 6/1952 | Wehrli | D03D 29/00 139/34 |
| 2,663,066 | A | * | 12/1953 | Berger | D03D 29/00 28/152 |
| 2,707,316 | A | * | 5/1955 | Doniger | D03D 29/00 28/151 |
| 2,802,255 | A | * | 8/1957 | Wallach | D03D 29/00 139/34 |
| 3,530,558 | A | * | 9/1970 | Gick | A41G 1/02 217/57 |
| 3,636,987 | A | * | 1/1972 | Forby | D03D 29/00 28/151 |
| 3,708,839 | A | * | 1/1973 | Prince | D03D 29/00 28/150 |
| 4,044,437 | A | * | 8/1977 | Ebenstein | D03D 29/00 28/151 |
| 6,149,437 | A | * | 11/2000 | Corliss | B44C 3/06 139/29 |

(Continued)

*Primary Examiner* — Bobby Muromoto, Jr.
(74) *Attorney, Agent, or Firm* — Brian G. Gilpin; Godfrey & Kahn, S.C.

(57) ABSTRACT

A bead weaving loom includes a weave frame with a front wall connected to a rear wall by a plurality of frame legs, and a tray having a plurality of bead receiving cavities for receiving a plurality of beads, wherein the tray may be removably situated on the frame.

19 Claims, 6 Drawing Sheets

(56) References Cited

U.S. PATENT DOCUMENTS

| | | | | |
|---|---|---|---|---|
| 6,719,013 | B1 * | 4/2004 | D'Estais | D03D 29/00 139/29 |
| 7,147,008 | B2 * | 12/2006 | Sayler | D03D 29/00 139/11 |
| 7,677,273 | B2 * | 3/2010 | Skaflestad | D03D 29/00 139/1 R |
| 8,066,035 | B1 * | 11/2011 | Stevens | D03D 29/00 139/29 |
| 8,132,596 | B2 * | 3/2012 | Weidler | D03D 29/00 139/29 |
| 9,121,117 | B2 * | 9/2015 | Teramoto | D04D 1/04 |
| D751,124 | S * | 3/2016 | Miller | D15/66 |
| 9,506,171 | B2 * | 11/2016 | Nitta | D03D 29/00 |
| 2004/0069363 | A1 * | 4/2004 | D'Estais | D03D 29/00 139/1 R |
| 2005/0247745 | A1 * | 11/2005 | Spor | D03D 29/00 223/48 |
| 2006/0157137 | A1 * | 7/2006 | Sayler | D03D 29/00 139/29 |
| 2009/0293982 | A1 * | 12/2009 | Skaflestad | D03D 29/00 139/34 |
| 2010/0212770 | A1 * | 8/2010 | Weidler | D04D 1/04 139/33 |
| 2010/0269947 | A1 * | 10/2010 | Spear | D03D 29/00 139/29 |
| 2011/0259465 | A1 * | 10/2011 | Schaub | D03D 29/00 139/29 |
| 2014/0166150 | A1 * | 6/2014 | Teramoto | D04D 1/04 139/29 |
| 2015/0096643 | A1 * | 4/2015 | Lawrence | D03D 29/00 139/33 |
| 2015/0337466 | A1 * | 11/2015 | Nitta | D03D 41/00 139/34 |

* cited by examiner

BEAD WEAVING LOOM

CROSS REFERENCE TO RELATED APPLICATIONS

The present application claims priority to U.S. Provisional Patent Application No. 62/092,705 titled BEAD WEAVING LOOM, filed on Dec. 16, 2014, which is herein incorporated by reference in its entirety.

FIELD OF THE INVENTION

The present invention relates generally to the field of weaving looms. More particularly, the invention relates to a portable weaving loom which can be used for hand weaving beaded bands.

BACKGROUND

Portable bead weaving looms are used for hand weaving, particularly the weaving of beaded bands and the like which may be made into various articles such as belts, bags, purses and like items. The purpose of the loom is to hold longitudinally extending threads (called "warps") in spaced relation while threading beads on cross threads (called "wefts") in a known manner to form a beaded band or other product. Most beading looms in the current market are set up by first wrapping one end of the warp thread around a screw or thread through a fine slit on the loom while holding it tight, sliding the long end of the warp thread through a center slit, wind it around the opposite screw, return it through the opposite center slit, etc., (keeping the tension even) until the warp thread has gone through all the slits needed for the width of the design. This process requires a measure of skill and strength. Existing bead weaving looms do not accommodate combs of differing sizes or configurations to secure threads. They also do not provide means for easily placing the beads on threads.

As such, there is a need for an improved beading loom. In one embodiment, a loom in accordance with the present invention can accommodate interchangeable combs so that it can be used with a range of bead sizes and thread types. And in another embodiment, the loom includes a bead tray wherein the beads can be placed so as to create the desired pattern and facilitate picking up the beads. It should be noted that a beading loom need not achieve all of these benefits in order to be in accordance with the present invention.

SUMMARY OF THE INVENTION

The above considerations, and others, are addressed by the present invention, which can be understood by referring to the specification, drawings, and claims. Disclosed herein is a user-friendly bead weaving loom with a unique design that makes it easier to set up than weaving bead looms currently on the market. The bead weaving loom accommodates a wide range of bead sizes and a variety of threads using interchangeable combs. It is easy to store, easy to use, and suitable for the needs of beginners through advanced bead artists. The interchangeable combs accommodate a wide range of bead sizes and threads types.

In at least some embodiments, an exemplary bead weaving loom is directed to a weave frame including a front wall connected to a rear wall by a plurality of frame legs, and a tray having a plurality of bead receiving cavities for receiving a plurality of beads, wherein the tray is removably situated on the frame.

In at least some additional embodiments, an exemplary bead weaving loom is directed to a weave frame having a center cavity substantially formed by a front wall interconnected with a rear wall by a plurality of frame legs; a tray adapted to be received within the cavity and releasably supported at least partially by one or more of the plurality of legs, the front wall, and the rear wall; a front comb interconnected with the front wall and configured to receive a plurality of linear members at least partially therein; a rear comb interconnected with the rear wall and configured to receive a plurality of linear members at least partially therein; a first securing means for releasably securing the plurality of linear members about the front wall; and a second securing means for releasably securing the plurality of linear members about the rear wall.

In some further embodiments, an exemplary bead weaving loom is directed to a frame having a short front wall, a tall rear wall, legs connected between the front wall and rear wall, and a tray releasably received in a space between the legs. The outer edges of the sides of the tray extend over the tops of the loom frame legs so that the tray sits in the frame and can be carried with the frame. Each wall has an elongated slot adapted to receive a plurality of thread ends, and a comb receiving indentation adapted to receive a comb. Each slot is adapted to receive the ends of thread draped over its respective comb, so that, after the ends of thread are placed inside the slot, the ends are then held within the frame by inserting the wedge into the slot, thereby wedging the ends in the slot, so that the ends cannot be removed from the frame until the wedge is removed from the slot.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiments, and will be readily apparent to those skilled in the art. Such objects, features, benefits and advantages will be apparent from the above as taken in conjunction with the accompanying figures and all reasonable inferences to be drawn therefrom.

BRIEF DESCRIPTION OF THE DRAWINGS

The accompanying drawing figures, which are incorporated in and constitute a part of the description, illustrate several aspects of the invention and together with the description, serve to explain the principles of the invention. The following description is based on embodiments of the invention and should not be taken as limiting the invention with regard to alternative embodiments that are not explicitly described herein. A brief description of the figures is as follows.

Figure 1:
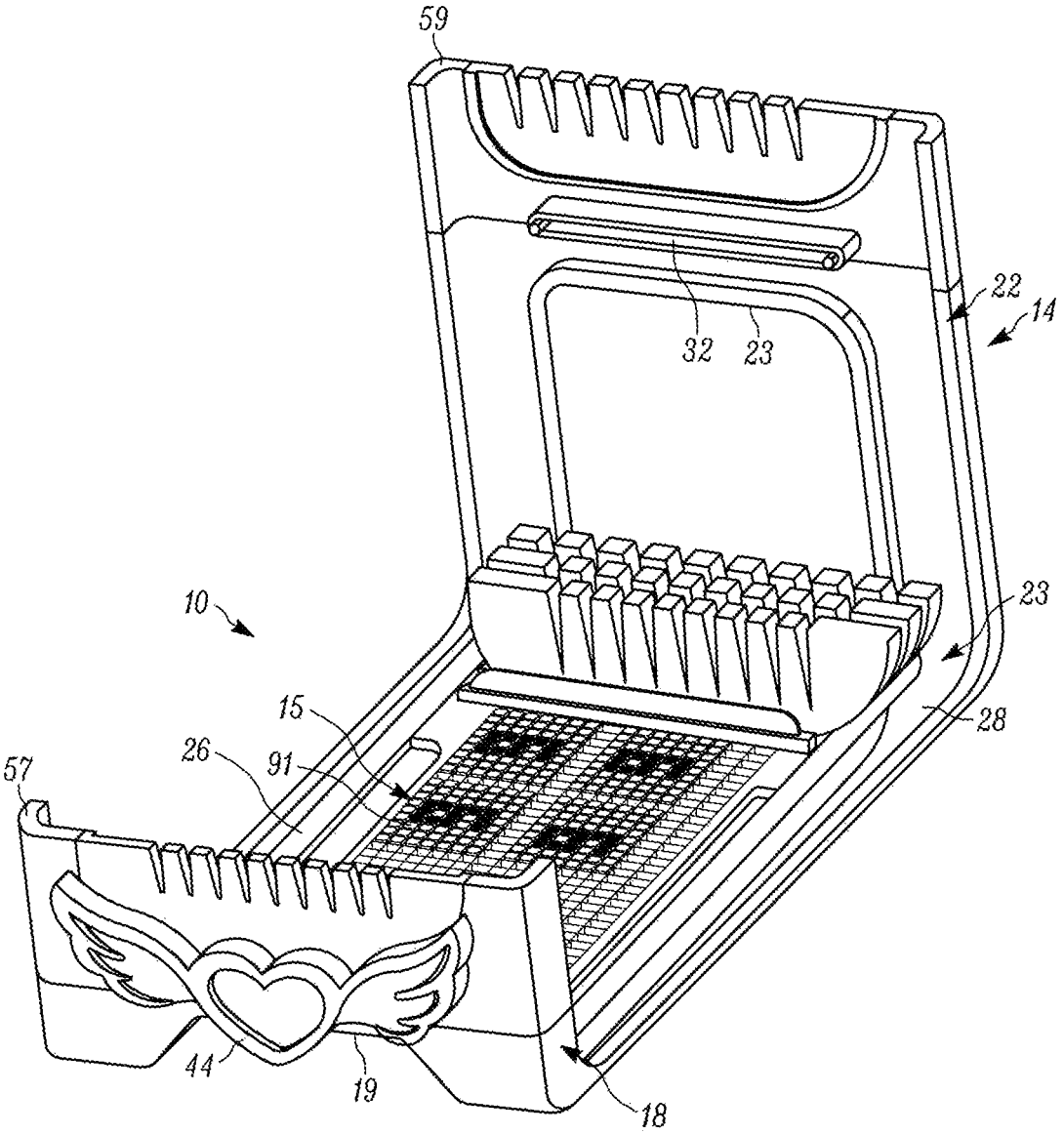
FIG. 1 is a perspective view of one embodiment of a loom.

In view of the many possible embodiments to which the principles of the present invention may be applied, it should be recognized that the embodiments described herein with respect to the drawing figures are meant to be illustrative only and should not be taken as limiting the scope of the invention.

DETAILED DESCRIPTION OF AN EXEMPLARY EMBODIMENT

Figure 2:
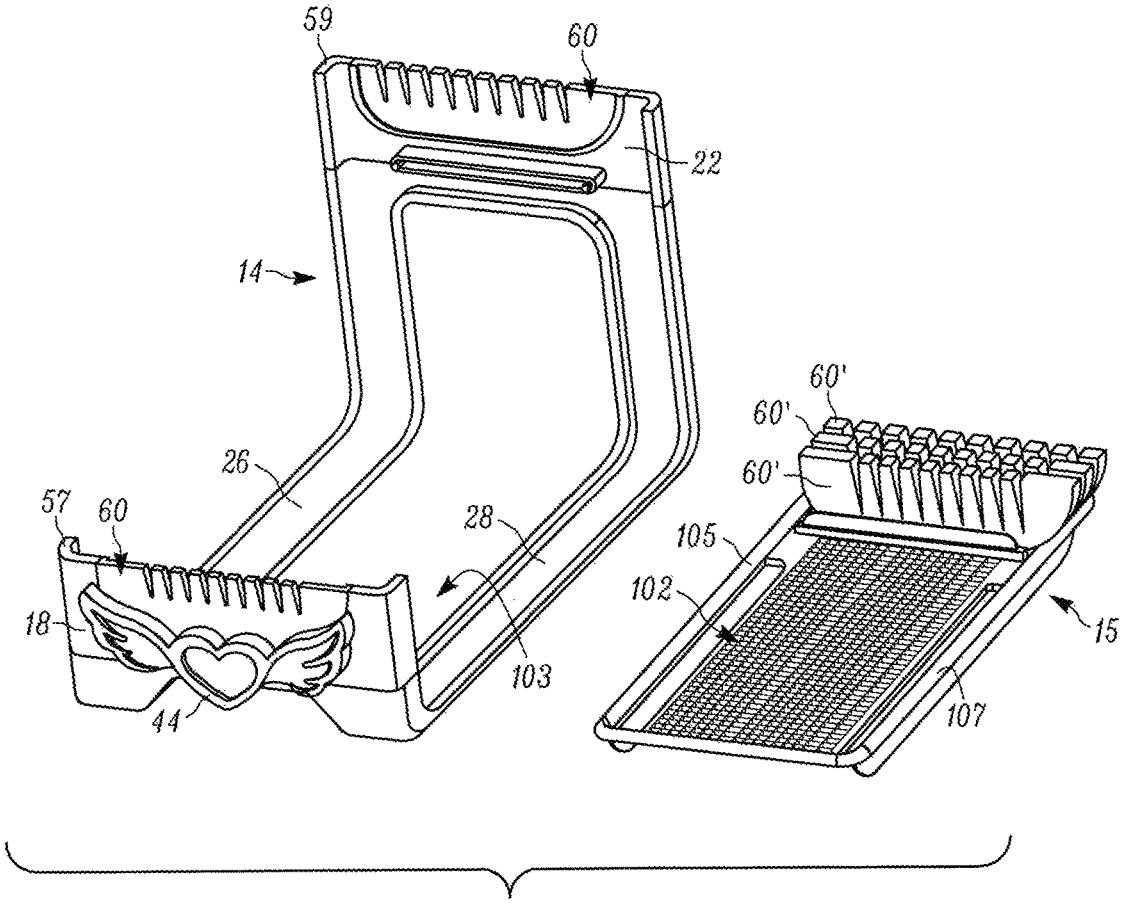
FIG. 2 is a perspective view of the loom of FIG. 1 with a tray shown separated from a loom frame.
Figure 3:
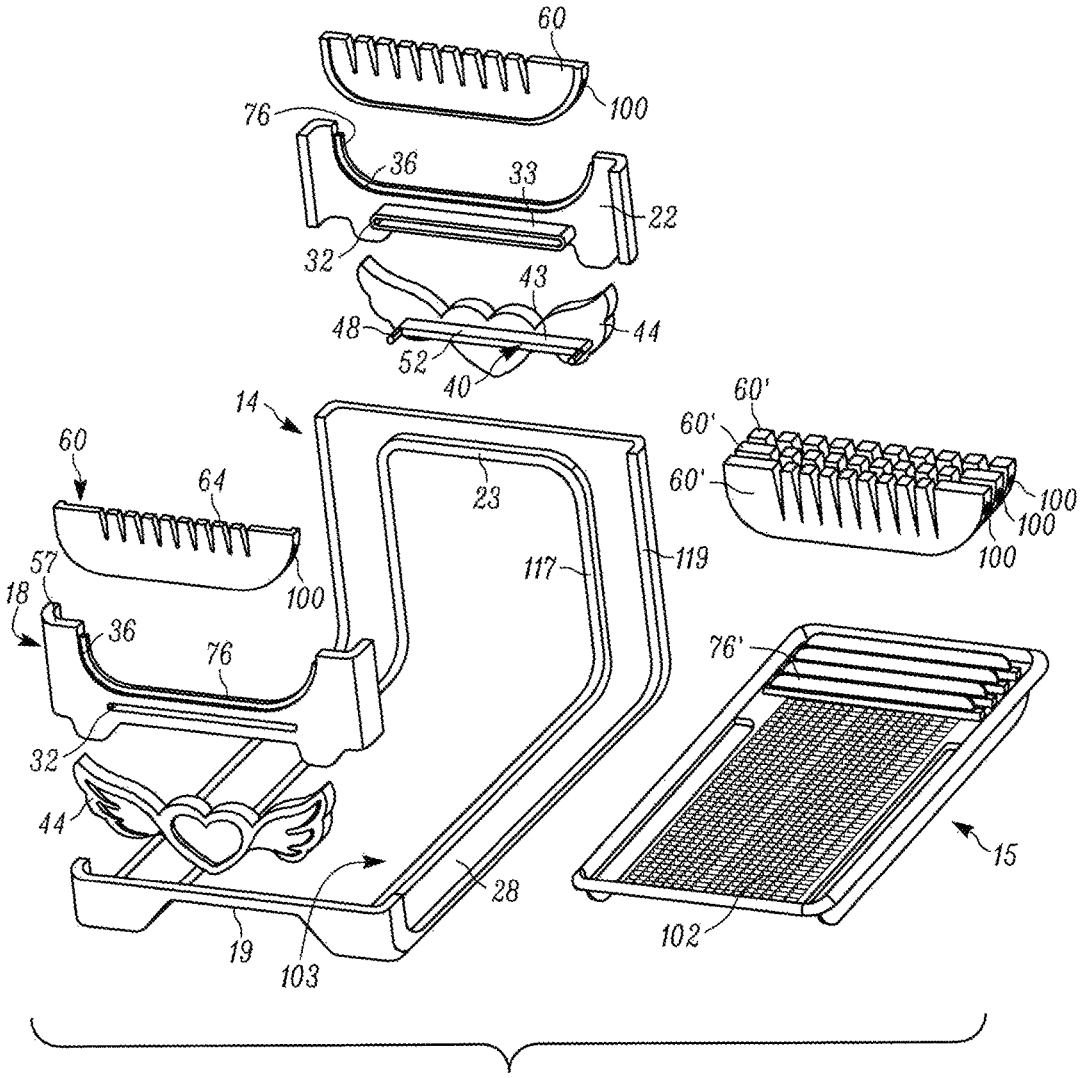
FIG. 3 is an exploded perspective view of the loom of FIG. 1.

Reference will now be made in detail to exemplary aspects of the present invention which are illustrated in the accompanying drawings showing illustrative embodiments. Referring to FIGS. 1 and 2, a weave loom 10 is provided that includes a frame 14 and a tray (i.e., bead and comb holder) 15. The frame 14 has a short front wall 18, a rear wall 22 that is taller than the front wall 18, and opposing frame legs 26 and 28 connected between the front wall 18 and the rear wall 22, which together form the frame 14. The front wall 18 includes a front wall base 19 and a front wall top portion 57. The rear wall 22 includes a rear wall base 23 and a rear wall top portion 59. The frame 14, and the tray 15 are molded from a durable lightweight plastic, but other materials could be used in addition to or in place of plastic. As shown in FIG. 3, each wall 18 and 22 has a respective slot 32, and a comb receiving indentation 36 (e.g., cut out), as further described below.

Further referring to FIG. 3, the loom 10 also includes two wedges 40, including a front wedge 41 (FIG. 5) for the front wall 18, and a rear wedge 43 for the rear wall 22. Each wedge 40 is an elongated member adapted to be received in one of the slots 32. In at least some embodiments, the wedge 40 can include an end plate 44 which serves as a wedge handle. The end plate 44 can be configured in various ways, for example it may include a decorative shape, or otherwise be a planar member. In at least some embodiments, the wedge 40 includes a central bar portion 52 that is tapered, with a narrow end, and an opposite wider end adjacent the end plate 44, although in some other embodiments (not shown) the wedge is not tapered, and can be a flat planar member. The bar portion 52 is sized and shaped to fit at least partially into the slots 32. In at least some embodiments, each side of the bar portion 52 can include an alignment pin 48 that extends from the bar portion 52, opposite the end plate 44 position. The pin 48 is configured to extend into the slot 32 to aid in the alignment of the wedge 40 with its respective slot 32. In at least some embodiments, the wedge 40 has a bow type shape. The slots 32 can further include a slot ridge 33 that extends around each of the slots 32 on the inside of the loom frame 14, to add further rigidity to the front wall 18 and rear wall 22.

Referring further to FIG. 3, each comb receiving indentation 36 is positioned along the top portion of a wall, more particularly, along a front top portion 57 of the front wall 18 and a rear top portion 59 of the rear wall 22. Each of the front and rear walls 18, 22 include respective comb receiving indentations 36 in order to receive a respective comb 60. The combs 60 are sized and shaped to be matingly received by the walls 18, 22. To assist with securing the combs 60 to the walls 18, 22, each comb includes a comb channel (e.g., a slot, depression, etc.) 100 that interfaces and is received at least in part by a comb support 76. Each comb support 76 extends from a respective comb receiving indentation 36 and receives, and removably secures, the comb 60 to a respective wall.

Figure 4:
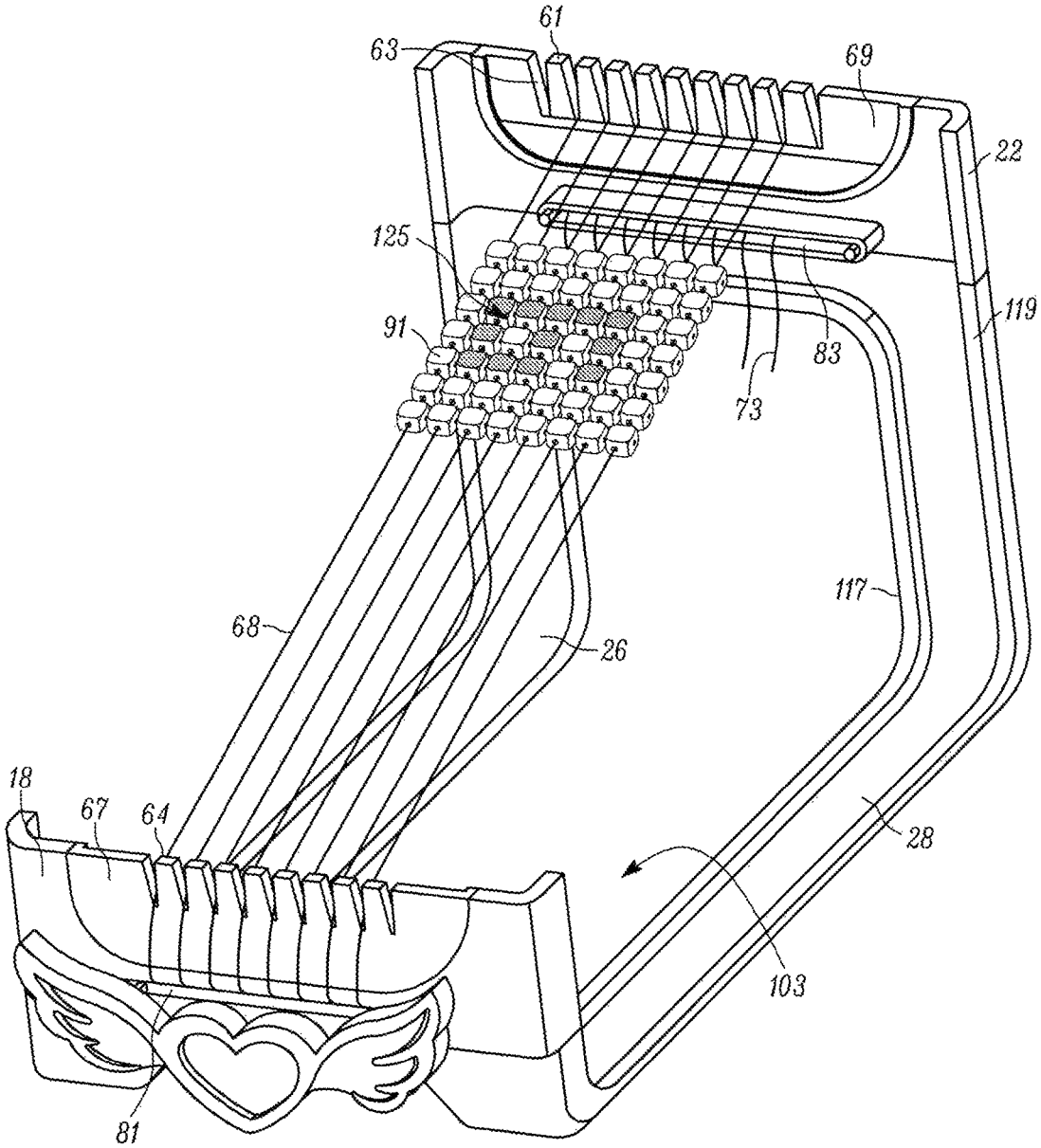
FIG. 4 is a perspective view of the loom of FIG. 1 with a plurality of linear members secured to each end of the loom and a plurality of beads installed thereon.

Referring to FIG. 4, the combs 60 are configured to receive and align a plurality of linear members 68 (e.g., piece of thread, cord, yarn, string, etc.) using a plurality of serrations 64, which are formed from alternating peaks 61 and valleys 63, with each valley being adapted to receive a respective portion of the linear member 68. At least one set of two combs 60 with similar serrations is provided, such as a front comb 67 and a rear comb 69. To assist with securing linear members 68 of various types and having varied thicknesses, additional combs 60' can be provided (see FIGS. 3 and 5), in sets, with each set having different serration configurations, such that the spacing between valleys, as well as the valley widths, are sized to properly receive and align varied linear members 68. Various modifications and other comb configurations can also be used to receive and align numerous types of linear members 68.

Combs 60 received by the comb receiving indentations 36 are oriented such that the comb serrations 64 are exposed at the top for receiving the linear members 68. As described above, each wall 18 and 22 includes a respective slot 32 that extends parallel to the comb serrations 64, for example, the front wall 18 can include a front slot 81 (see FIG. 4) and the rear wall 22 can include a rear slot 83. Each slot 32 is adapted to receive the ends of the linear members 68, which are draped over its respective comb and into the serrations 64. For example, after a front end portion 72 of each respective linear member 68 inserted through the front slot 81, the front end portion 72 is then secured to the frame 14 by inserting the front wedge 41 (FIG. 5) into the front slot 81, thereby wedging the front end portion 72 in the front slot 81, so that the front end portion 72 cannot be removed until the front wedge 41 is removed from the front slot 81. In this manner the linear member 68 is secured to the front wall 18. Similarly, the rear end portion 73 of each respective linear member 68 can be inserted through the rear slot 83 the rear end portion 73 is then secured to the frame 14 by inserting the rear wedge 43 into the rear slot 83, thereby wedging the rear end portion 73 in the rear slot 83.

Figure 6:
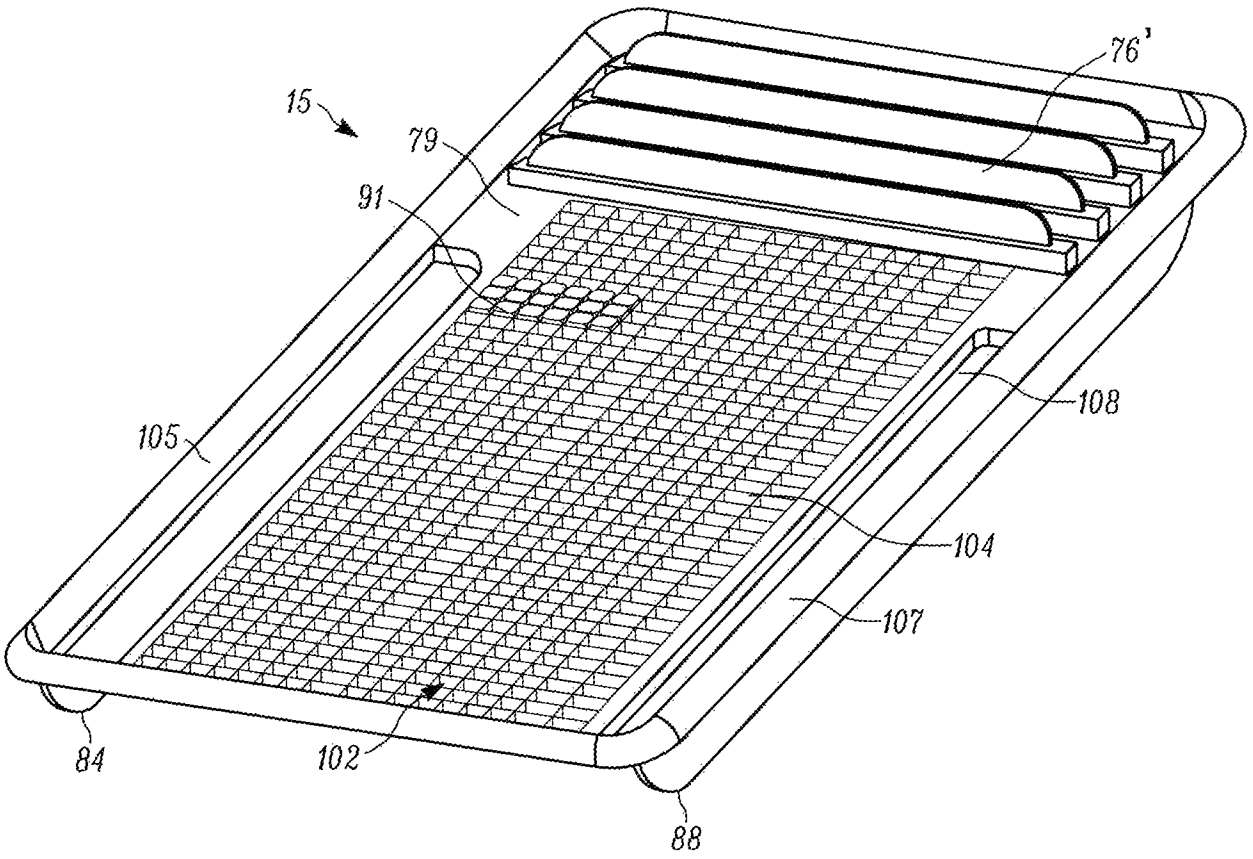
FIG. 6 is a top perspective view of the tray.

As discussed above, the loom 10 includes both the frame 14 and the removable tray 15. Referring now to FIG. 6, the tray 15 includes a plurality of legs extending therefrom. In at least some embodiments, the plurality of legs includes longitudinally extending tray legs 84, 88, although in other embodiments, more or less legs can be included and extending from other portions of the tray 15.

The tray 15 can serve many purposes. For example, the tray can provide storage for combs when not in use, such as the front comb 67, rear comb 69, and additional combs 60'. When one set of combs 60 is situated in the frame walls 18, 22, the other additional combs 60' are placed for storage on respective upstanding comb supports 76' extending from a tray top surface portion 79 of the tray 15. Another purpose of the tray is to provide an area within the loom 10 where a plurality of beads 91 can be laid out in a desired pattern. By incorporating such an area into the loom 10, the loom 10 eases the process of creating beaded material. To facilitate the holding of the beads 91, the tray 15 can include a bead grid (e.g., an array) 102 formed from a plurality of individual bead receiving indentations 104 extending in both an X and a Y direction. The bead receiving indentations 104 are adapted to receive a single bead and to temporarily confine that bead to a set position in the bead grid 102. To provide an expansive design, the bead grid 102 can cover a substantial portion of the tray 15 between the end of the tray with the upstanding comb supports 76' and the tray's opposite end. In at least some embodiments, although not necessary, longitudinally extending tray channels 108 can be provided between the tray ends and the sides of the tray, outside of the bead grid 102 to provide additional rigidity to the tray 15 or to store loose beads 91.

Referring again to FIGS. 3 and 4, in order to use less material and to improve the loom frame's overall appearance, the loom frame 14 is substantially or completely devoid of material in a central area bordered by the front wall 18, rear wall 22, and the frame legs 26, 28. In order to provide additional rigidity to the loom frame 14 without adding substantially more material to the frame 14, in at least some embodiments, the frame 14 includes an inner ridge 117 and an outer ridge 119. The inner ridge 117 extends around inner portions of the front wall 18, the rear wall 22, and the frame legs 26, 28. The outer ridge 119 extends around at least portions of the outer surface of the front wall 18, the rear wall 22, and the frame legs 26, 28. Although not shown, some material could be present in the central area for additional structural rigidity as desired or needed.

Figure 5:
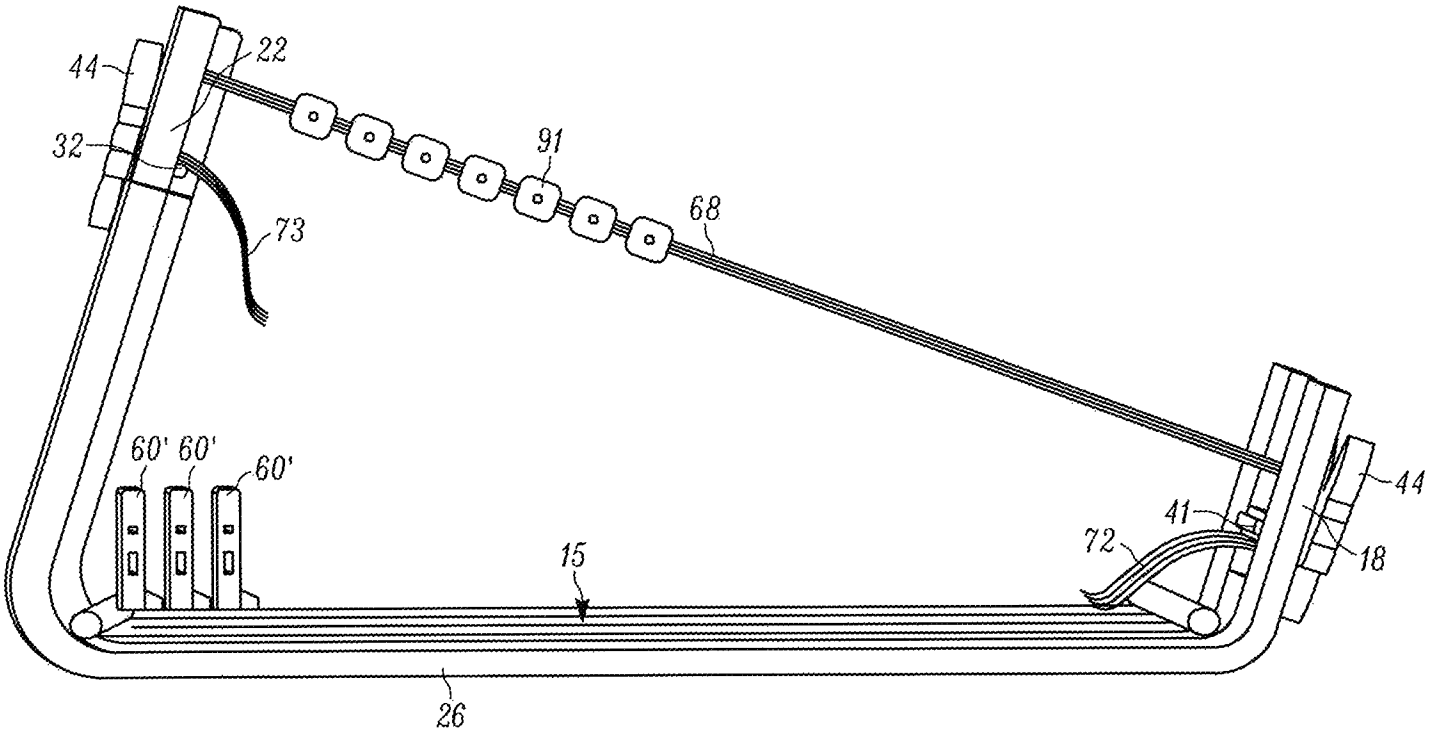
FIG. 5 is a side view of the loom of FIG. 4.

The area situated between the frame legs 26, 28 and at least portions of the front wall 18 and rear wall 22 serve to define a center cavity 103 that is adapted to receive the tray 15. The center cavity 103 provides a space for storing and transporting the tray 15 with the frame 14. In at least some embodiments, the tray 15 can be stored in between the frame legs 26, 28. In such a configuration, and as shown in FIGS. 1 and 5, the tray 15 includes outer edge portions, such as outer edge portions 105, 107 that extend along the longitudinal sides of the tray 15. The tray 15 can be placed inside the center cavity 103 such that the outer edge portions 105, 107 extend over and rest on, the frame legs 26, 28, this allows the tray 15 to sit in the frame 14 and can therefore be conveniently stored and transported with the frame 14. In at least some embodiments, the outer edge portions 105, 107 can rest on the inner ridge 117 portion of the frame legs 26, 28. Further in at least some embodiments, the tray legs 84, 88 can rest on the frame legs 26, 28 without the outer edge portions 105, 107 contacting the inner ridge 117. In addition, the tray legs 84, 88 can rest inside the center cavity 103 and in abutment with the sides of the frame legs 26, 28, while the outer edge portions 105, 107 rest on the frame legs 26, 28. In such a configuration, the tray 15 is removably secured to the frame 14 in both a vertical and horizontal manner.

In addition to the novel configuration of the frame 14 and tray 15, the loom is also easy to use. To begin use, a user warps the linear members 68 by gently placing them over the interchangeable combs 60 at the front and the back of the frame 14. Then the wedges 40 are pushed into the slots 32 to secure the warp linear members on the frame 14. This function keeps the linear members in tension with minimal effort.

Before threading beads 91 onto the linear members 68, one can use tweezers to pick up the beads and lay out the complete pattern of beads on the tray 15 that form a bead design 125 (FIGS. 1 and 4) in the color sequence of their choice on the bead grid 102. The bead grid 102 provides the finished color pattern, easily permitting further adjustment, and makes the picking up and threading of the beads easier and faster.

To proceed, the user cuts off a length of beading (weft) thread. Using a needle to pick up the first row of beads 91 from the bead grid 102, the user threads the beads on the needle, and then slips them down the thread to the bottom, snug against the beading threads. The use of the tray 15 along with pre-arranged bead grid 102 allows a user to transfer all the beads, in their proper order, to the warped linear members for securement in a single action. The user then passes the needle under all the warp threads and while holding the beads, the user slips each one into a space between successive warp threads then passes the needle through the beads from the opposite direction, but this time above each of the warp threads. This will lock the beads into place for the row. The sequence is repeated for each row. As the user nears the end of the weft thread, the user runs the thread through the bead row an extra time and cuts it off. Or the thread can be folded back and hidden inside a felt backing cut to size and glued or sewed on the back.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. Further, it is to be understood that in at least some embodiments, plurality can included one or more of an element.

What is claimed is:

1. A bead weaving loom comprising:

a weave frame having a center cavity substantially formed by a front wall interconnected with a rear wall by a plurality of frame legs;

a tray adapted to be received within the cavity and releasably supported at least partially by one or more of the plurality of legs, the front wall, and the rear wall;

a front comb interconnected with the front wall and configured to receive a plurality of linear members at least partially therein;

a rear comb interconnected with the rear wall and configured to receive a plurality of linear members at least partially therein;

a first securing means for releasably securing the plurality of linear members about the front wall; and a second securing means for releasably securing the plurality of linear members about the rear wall.

2. The bead weaving loom of claim 1, wherein the front comb is releasably interconnected with the front wall, and the rear comb is releasably interconnected with the rear wall.

3. The bead weaving loom of claim 2, wherein the tray further comprises a plurality of comb supports for receiving at least one the front comb and rear comb.

4. The bead weaving loom of claim 3, further comprising a plurality of additional combs, wherein each of the additional combs can be utilized in place of the front or rear combs, and wherein the plurality of additional combs are also receivable by the comb supports.

5. The bead weaving loom of claim 3, wherein the tray further comprises a plurality of bead receiving indentations for receiving a plurality of beads.

6. The bead weaving loom of claim 4, wherein the plurality of bead receiving indentations are situated in an array configuration so as to provide for at least one of bead storage and pre-arrangement of a bead design.

7. The bead weaving loom of claim 6, wherein the tray includes a plurality of outer edge portions that engage the plurality of frame legs when the tray is positioned in the center cavity.

8. The bead weaving loom of claim 7, wherein the tray includes a plurality of support legs, that are configured to cooperatively assist with the plurality of outer edge portions to engage the plurality of frame legs when the tray is positioned in the center cavity.

9. The bead weaving loom of claim 4, wherein the front comb, rear comb, and additional combs each include a depression for engaging the comb supports situated on the frame and the tray.

10. The bead weaving loom of claim 1, wherein the first securing means includes a front slot extending through the front wall and a front wedge adapted to be inserted into the front slot along with the plurality of linear members.

11. The bead weaving loom of claim 10, wherein the second securing means includes a rear slot extending through the rear wall and a rear wedge adapted to be inserted into the rear slot along with the plurality of linear members.

12. A bead weaving loom comprising:

a weave frame including a front wall connected to a rear wall by a plurality of frame legs; and a tray having a plurality of bead receiving indentations for receiving a plurality of beads, wherein the tray is removably situated on the frame, and wherein the plurality of bead receiving indentations are situated in an array configuration so as to provide for at least one of bead storage and pre-arrangement of a bead design.

13. The bead weaving loom of claim 12, wherein the tray is supported at least partially by one or more of the plurality of legs, the front wall, and the rear wall.

14. The bead weaving loom of claim 13 further comprising:

a front comb releasably secured to the front wall and configured to receive a plurality of linear members at least partially therein; and a rear comb releasably secured to the rear wall and configured to receive the plurality of linear members at least partially therein.

15. The bead weaving loom of claim 14, wherein the tray further comprises a plurality of comb supports for releasably securing at least one the front comb and rear comb.

16. The bead weaving loom of claim 15, further comprising a plurality of additional combs, wherein each of the additional combs can be utilized in place of the front or rear combs, and wherein the plurality of additional combs are releasably securable to the comb supports.

17. The bead weaving loom of claim 16, wherein the plurality of linear members include at least one of string, yarn, cord, and thread.

18. The bead weaving loom of claim 17, further comprising:

a front slot extending through the front wall;

a front wedge adapted to be inserted into the front slot along with the plurality of linear members for releasably securing the plurality of linear members about the front wall;

a rear slot extending through the rear wall; and a rear wedge adapted to be inserted into the rear slot along with the plurality of linear members for releasably securing the plurality of linear members about the rear wall.

19. The bead weaving loom of claim 18, wherein the tray includes a plurality of outer edge portions that rest on a top surface of the plurality of frame legs.

* * * * *